US007051516B2

(12) United States Patent
Pott et al.

(10) Patent No.: US 7,051,516 B2
(45) Date of Patent: May 30, 2006

(54) METHOD FOR CONTROLLING A WORKING MODE OF AN INTERNAL COMBUSTION ENGINE

(75) Inventors: Ekkehard Pott, Gifhom (DE); Michael Zillmer, Sickte (DE)

(73) Assignee: Volkswagen AG, Wolfsburg (DE)

( * ) Notice: Subject to any disclaimer, the term of this patent is extended or adjusted under 35 U.S.C. 154(b) by 64 days.

(21) Appl. No.: 10/467,092

(22) PCT Filed: Feb. 1, 2002

(86) PCT No.: PCT/EP02/01075

§ 371 (c)(1),
(2), (4) Date: Dec. 1, 2003

(87) PCT Pub. No.: WO02/077430

PCT Pub. Date: Oct. 3, 2002

(65) Prior Publication Data

US 2004/0074228 A1 Apr. 22, 2004

(30) Foreign Application Priority Data

Feb. 28, 2001 (DE) ..... 101 10 500

(51) Int. Cl.
*F01N 3/00* (2006.01)

(52) U.S. Cl. ..... 60/285; 60/274; 60/286; 123/481; 123/493

(58) Field of Classification Search ..... 60/274, 60/284, 285, 286; 123/481, 493, 681, 682, 123/492

See application file for complete search history.

(56) References Cited

U.S. PATENT DOCUMENTS

| | | | | |
|---|---|---|---|---|
| 6,059,057 | A * | 5/2000 | Yamazaki et al. | 180/65.2 |
| 6,148,611 | A * | 11/2000 | Sato | 60/274 |
| 6,173,569 | B1 * | 1/2001 | Kusada et al. | 60/277 |
| 6,240,721 | B1 * | 6/2001 | Ito et al. | 60/274 |
| 6,321,530 | B1 * | 11/2001 | Hoshi et al. | 60/274 |
| 6,560,960 | B1 * | 5/2003 | Nishimura et al. | 60/284 |

* cited by examiner

*Primary Examiner*—Binh Q. Tran
(74) *Attorney, Agent, or Firm*—Norris McLaughlin & Marcus PA

(57) ABSTRACT

The invention relates to a method for controlling a temperature of a catalyst system (14, 16) located in an exhaust duct (12) of an internal combustion engine (10) in a motor vehicle. Said system comprises at least one primary catalyst (16), in particular an $NO_x$ storage catalyst and optionally one or more pre-catalysts (14). According to the invention, at one point during operation, at which the torque desired by the driver is less than an overrun torque of the vehicle (overrun phase $\tau_s$), an overrun shut-off can be suppressed by supplying the internal combustion engine (10) with an air-fuel ratio ($\lambda$) that is less than or equal to 1.1.

30 Claims, 4 Drawing Sheets

METHOD FOR CONTROLLING A WORKING MODE OF AN INTERNAL COMBUSTION ENGINE

Figure 1:
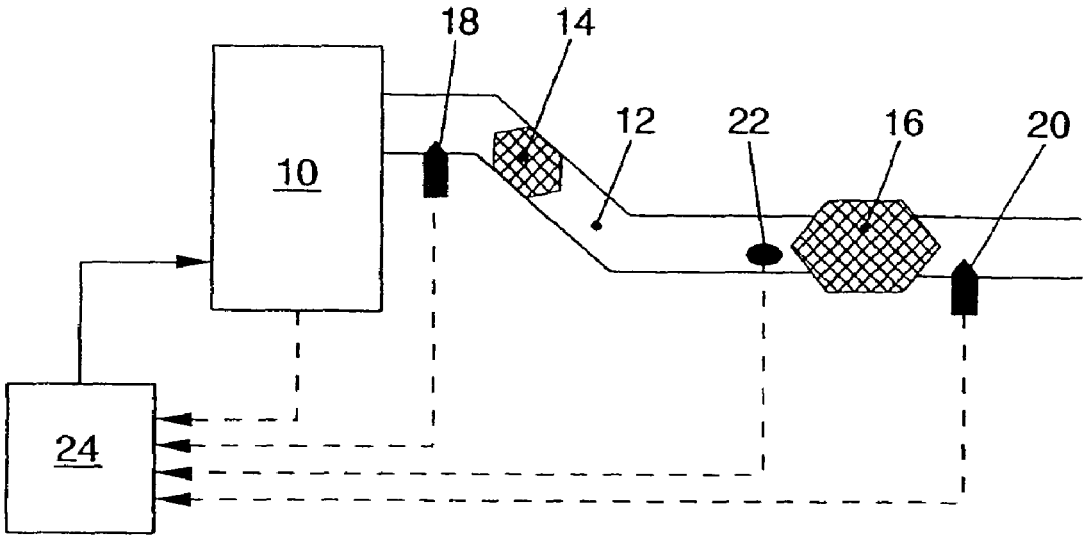

The invention relates to a method for controlling a temperature of a catalyst system located in an exhaust duct of an internal combustion engine of a motor vehicle.

For post-treatment of exhaust gases of lean-running internal combustion engines, it is known to pass the exhaust gas over a catalyst system arranged in an exhaust channel, in particular an $NO_x$ catalyst system. The $NO_x$ catalyst system includes at least one $NO_x$ storage catalyst and typically one or more pre-catalyst connected upstream. The internal combustion engine is operated discontinuously in lean and rich Lambda intervals, whereby nitric oxides ($NO_x$) of the exhaust gas are stored in the $NO_x$ storage catalyst during the lean operating intervals with $\lambda>1$ and released and reduced during the rich operating intervals with $\lambda<1$ ($NO_x$ regeneration). Converting other pollutants, such as carbon monoxides (CO) and unburned carbohydrates (HC), proceeds in a known manner on catalytic three-way components of the pre-catalyst and/or the $NO_x$ storage catalyst.

In comparison to pure three-way catalyst systems, $NO_x$ catalyst systems are relatively temperature-sensitive. The catalyst system can be irreversibly damaged even for exhaust gas temperatures above 800° C. upstream of the $NO_x$ storage catalyst and can cause a significant decrease in the catalyst activity over the lifetime of the vehicle. This applies to $NO_x$ storage and regeneration both during the lean and rich operating intervals as well as to the HC, CO and $NO_x$ conversion characteristic during a stoichiometric supply. Exhaust gas cooling measures for lowering the exhaust gas temperature are known that prevent a critical temperature limit from being exceeded. Another known measure for reducing the exhaust gas temperature includes enriching the air-fuel mixture to $\lambda<1$.

The overrun phases which cannot be prevented under typical driving conditions, represent a particular problem regarding the temperature load of the $NO_x$ catalyst system. Such overrun phases can occur, for example, during acceleration of the vehicle or on downgrades, when a desired driving torque set by the driver is less than an instantaneous overrun torque of the vehicle. During an overrun phase, the fuel supply is typically interrupted and the internal combustion engine is operated without firing (overrun fuel cutoff). As a result, high oxygen concentrations enter the exhaust gas and reach the catalyst system, which at the beginning of the overrun phase still contains high HC masses, in particular after operation under high load or full load. Local temperature peaks occur due to the exothermic conversion reaction of HC with oxygen, which can lead to an accelerated oxidation and/or sintering of the catalytic noble metal coatings, thereby permanently damaging the catalytic activity. This problem becomes more severe with the higher temperatures of the catalyst system attained during a drive phase of the vehicle that precedes an overrun phase, i.e. in particular following vehicle operation under high load or full load. The damaging potential of the overrun fuel cutoff is evident in engine tests where load cycles, that consist of high load and high exhaust gas temperatures alternating with unfired overrun phases, lead to a more severe deactivation of the $NO_x$ storage catalyst system than corresponding load cycles without intervening overrun phases.

In order to lessen the damaging effects caused by the massive oxygen supply to the catalyst in the overrun phases, it is known to substantially enrich the mixture under fired high-load and full load operation. In this way, the initial catalyst temperature at the beginning of the overrun phase is kept so low, that the additional load resulting from the oxygen supply does not reach the critical catalyst capacity. This substantial enrichment of the mixture under high load operation to compensate for the negative effects of the overrun fuel cutoff, however, cause a noticeable increase in fuel consumption. In order to keep the fuel consumption low, it is also known to regulate the degree of mixture enrichment depending on the exhaust gas and/or catalyst temperature. For example, a smaller enrichment of the mixture is set for brief acceleration under high load and comparatively low, uncritical catalyst temperatures than for the same operating point where the exhaust gas or catalyst temperature is already close to the critical temperature.

It is an object of the present invention to provide a method for controlling the temperature of a catalyst system which substantially eliminates damaging temperature peaks during overrun phases, in particular following operation of the internal combustion engine under high load or full load. The method should also keep fuel consumption as low as possible, not compromise the travel comfort and the travel safety, and be capable of being easily integrated in an engine control concept.

According to the invention, it is provided that at an operating point where a desired driving torque is a smaller than an overrun torque of the vehicle (overrun phase), an overrun fuel cutoff can be suppressed by supplying the internal combustion engine with an air-fuel ratio of Lambda smaller than or equal to 1.1. Particularly advantageous is a supply with $\lambda \leqq 1.00$.

If an overrun phase exists as a result of an operating condition, for example during a braking operation or a downgrade, which according to conventional methods is typically addressed by an overrun fuel cutoff, then the overrun fuel cutoff can be suppressed by operating the internal combustion engine with ignition while supplying an air-fuel mixture. In this way, a high oxygen supply of the catalyst system and hence damaging temperature peaks during overrun operation are suppressed, while the fuel consumption increases by only a small amount as compared to an unfired overrun fuel cutoff. The lifetime of the catalyst can thereby be significantly increased. The method is particularly advantageous for $NO_x$ catalyst systems due to the particular temperature sensitivity of the $NO_x$ storage catalysts.

According to a first embodiment of the method, the air-fuel ratio during a fired overrun phase is preset preferably in a range of $\lambda=0.95$ to 1.00. According to a particular advantageous embodiment, the air-fuel ratio during the fired overrun phase is preset as a function of a measured or calculated temperature of the exhaust gas and/or the catalyst system. If the temperature of at least one component of the catalyst system is already relatively close to a catalyst-specific critical temperature threshold at the beginning of the overrun phase, then a relatively low Lambda value, i.e., a strong mixture enrichment, is provided in the overrun phases in order to lower the temperature as much as possible. Conversely, if the temperature of the exhaust gas and/or the catalyst system is relatively low, then a Lambda value close to 1 can be preset. Moreover, the overrun fuel cutoff may not be suppressed at all; in other words, the overrun fuel cutoff is enabled, if the temperature of the exhaust gas and/or the $NO_x$ catalyst system does not exceed a presettable low temperature threshold. It will typically not to be advantageous to define different temperature thresholds for pre-catalysts and the primary catalyst and/or $NO_x$ storage catalysts that depend on a specific catalyst configuration, in particular a specific catalyst coating and/or catalyst support.

The prevention of temperature peaks by suppressing the overrun fuel cutoff makes it possible to increase a maximum allowable temperature of the exhaust gas and/or the catalyst system in fired high load and/or full load operation of the internal combustion engine (vehicle drive mode) over a conventionally permissible temperature, accompanied by only a small maximum enrichment of the mixture. The term vehicle drive mode in the present context indicates an operating phase where the internal combustion engine performs positive work, i.e., is not in an overrun phase. Specifically for $NO_x$ catalyst systems, an increased maximal exhaust gas and/or catalyst temperature of 30 to 150 K, in particular by 50 to 100 K, has proven to be advantageous in comparison to the state of the art. This corresponds to an increase in the Lambda value by $\Delta\lambda$=0.036 to 0.18, in particular by 0.06 to 0.12, as a result of the mixture enrichment to maintain the preset temperature in fired operation. In an actual situation, a maximum allowable temperature of the exhaust gas upstream of the pre-catalyst in a vehicle drive phase of the internal combustion engine can be preset to between 920 and 1040° C., preferably between 950 and 1000° C. Accordingly, a maximum allowable temperature of the exhaust gas upstream of the $NO_x$ storage catalyst in vehicle drive mode can be set to between 830 and 920° C., in particular between 850 and 880° C. The increased fuel consumption caused by the fired overrun phases can be essentially compensated or even overcompensated by increasing the maximum allowable temperature in vehicle drive mode. In spite of the altogether higher temperature level, the temperature of the catalyst system does not reach the critical temperature level due to the suppressed temperature peaks in the overrun phase.

The last-described embodiment of the method can advantageously be further improved by supplying the internal combustion engine in the fired overrun phase with an air-fuel mixture that is adjusted depending on the preset maximum allowable temperature of the exhaust gas and/or the $NO_x$ catalyst system. Although this measure leads to a relatively low Lambda value of typically 0.7 to 0.95 in particular between 0.8 and 0.9, in the overrun phase, the resulting fuel consumption is only slightly increased in comparison to the last-described embodiment of the method. Moreover, the lifetime of the catalyst system is extended due to the lower residual oxygen content in overrun mode. Temperature peaks are practically entirely eliminated due to the almost identical Lambda value obtained under load and in overrun mode.

A problem can develop in that firing during the overrun phases always generates a certain effective torque, so that any reduction in vehicle speed expected by the driver in the overrun phase is smaller than anticipated. This problem can be alleviated by another modification of the method, in that an effective torque produced in the overrun phase is partially compensated by shifting a time of ignition towards "retard", thereby partially compensating for the reduced engine efficiency. Since the exhaust gas temperature increases when the time of ignition is retarded, this measure has only limited use for preventing an effective torque.

The effective torque is particularly undesirable on downgrades, because the safety can be jeopardized by an increased braking distance. In addition, the damaging effect from the increased exhaust gas temperature is particularly pronounced, because a downgrade it is often preceded by a upgrade with full throttle, where maximum engine RPM and exhaust gas temperatures are reached. According to a particularly preferred method, suppression of the overrun fuel cutoff and/or the air-fuel ratio during the overrun phase and/or a maximum allowable temperature preset for the exhaust gas and/or the catalyst system during the overrun phase are regulated depending on a deviation of an actual vehicle speed and/or or an actual vehicle acceleration from a nominal vehicle speed and/or no nominal vehicle acceleration that is expected according to an actual torque on flat land. Accordingly, initially an upgrade or downgrade is identified by comparing the actual instantaneous vehicle speed with a nominal vehicle speed which is determined depending on the torque provided by the internal combustion engine for driving on flat land. Depending thereof, it is determined if suppression of the overrun fuel cutoff according to the invention is permitted, and if this is the case, then the air-fuel ratio with which the internal combustion engine is fired during the overrun phase is determined. Depending on the identified grade, the generation of an effective torque can thereby be completely or partially prevented.

In particular, the suppression of the overrun fuel cutoff can be canceled, i.e., overrun fuel cutoff can be allowed, if the downgrade identified based on the deviation of the actual vehicle speed and/or or acceleration from the nominal vehicle speed and/or or acceleration exceeds a presettable limit value. This eliminates excessively long braking distances on steep downgrades. Conversely, if the actual vehicle speed and/or acceleration is smaller than the nominal vehicle speed and/or acceleration on flat land, then an upgrade is identified and suppression of the overrun fuel cutoff is allowed.

Moreover, the air-fuel ratio during the overrun phase and/or or the preset value for the maximum allowable temperature of the exhaust gas and/or the catalyst system can be varied depending on the identified downgrade. In particular, the air-fuel ratio and/or the maximum preset temperature is increased step-by-step or continuously initially to $\lambda$=1.00 before the overrun fuel cutoff is performed when a presettable limit value is reached. In other words, Lambda is increased to at least approximately infinity.

The actual vehicle speed and/or or acceleration necessary for identifying the downgrade can be determined in a conventional manner, for example, via the engine RPM and an engaged gear and/or or based on a wheel rotation speed and a dynamic wheel radius. Other methods for determining the speed are also feasible. The theoretical nominal vehicle speed and/or or acceleration on flat land is preferably determined depending on a torque supplied by the internal combustion engine and measured by the engine controller. Alternatively, other engine control variables that approximately describe the engine torque can also be used, for example the position of the gas pedal, the quantity of injected fuel, a signal from the air mass measurement device and an exhaust gas Lambda signal. The engine torque and/or or the alternate quantities are then correlated with a change in the engine RPM during operation of the vehicle on flat land by using stored characteristic parameters. Other required parameters, such as vehicle mass, an air resistance coefficient or a roll resistance coefficient, can be also stored in the engine controller as fixed values or as a function of the determined actual vehicle speed and/or acceleration. The basic method for determining the nominal vehicle speed and/or acceleration on flat land is known from the control mode of the gear shifting processes in automatic transmissions and will therefore not be explained in detail.

Additional preferred embodiments of the invention are recited as features of the dependent claims.

Figure 2:
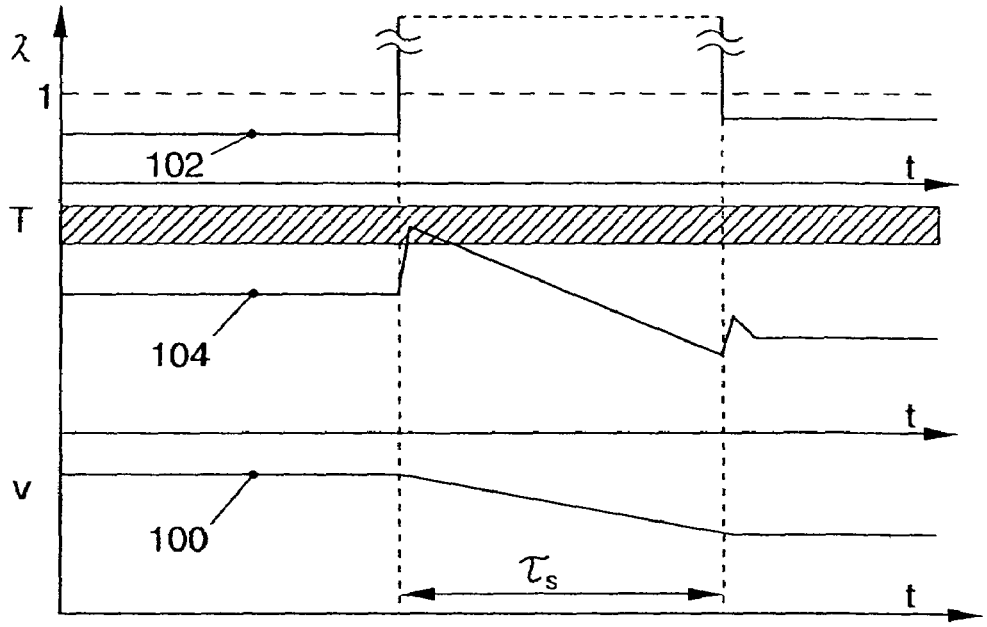
Figure 3:
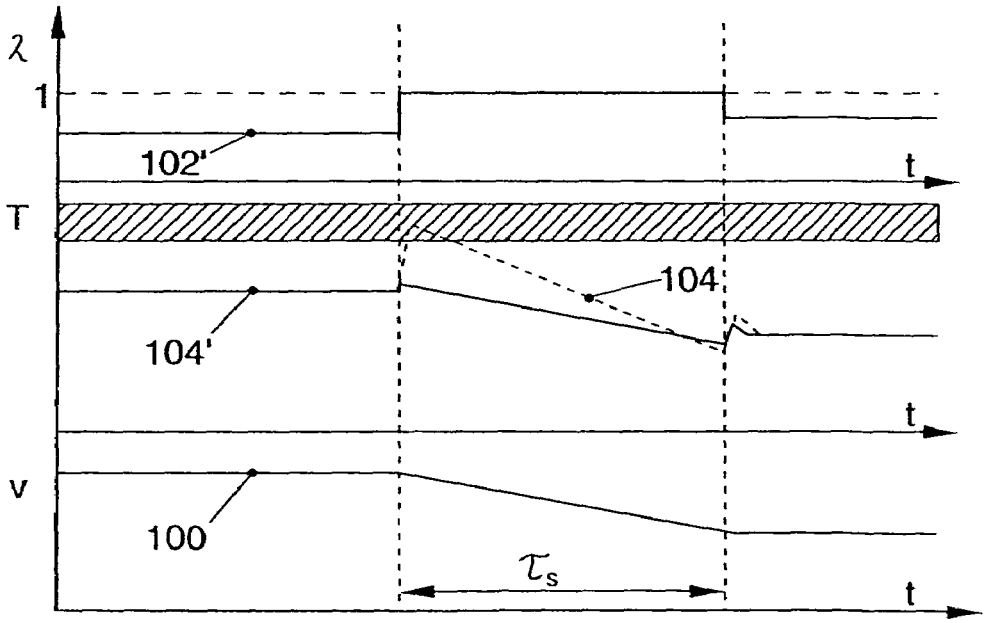
Figure 4:
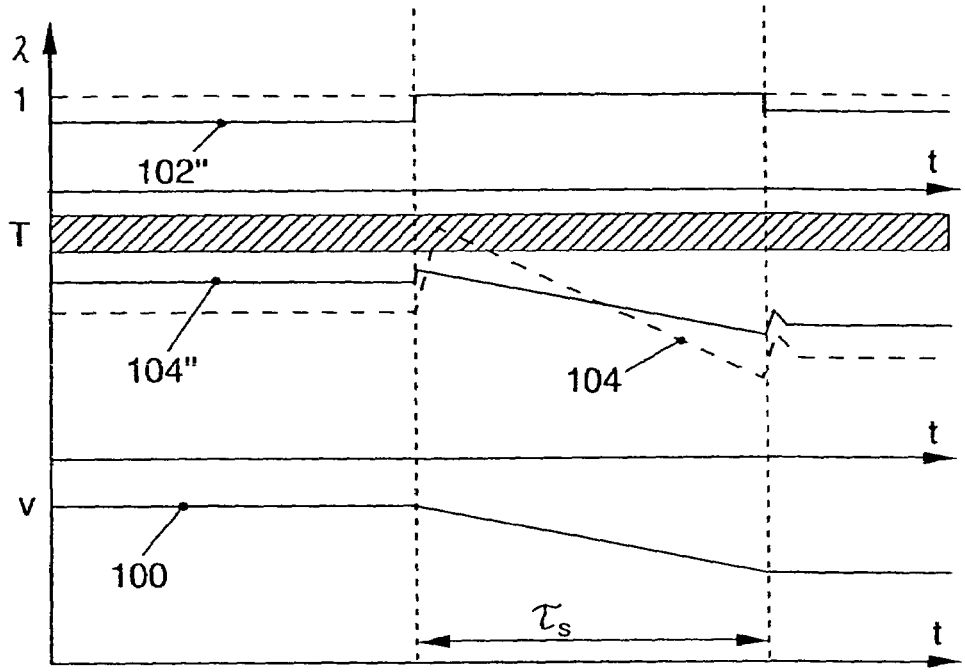
Figure 5:
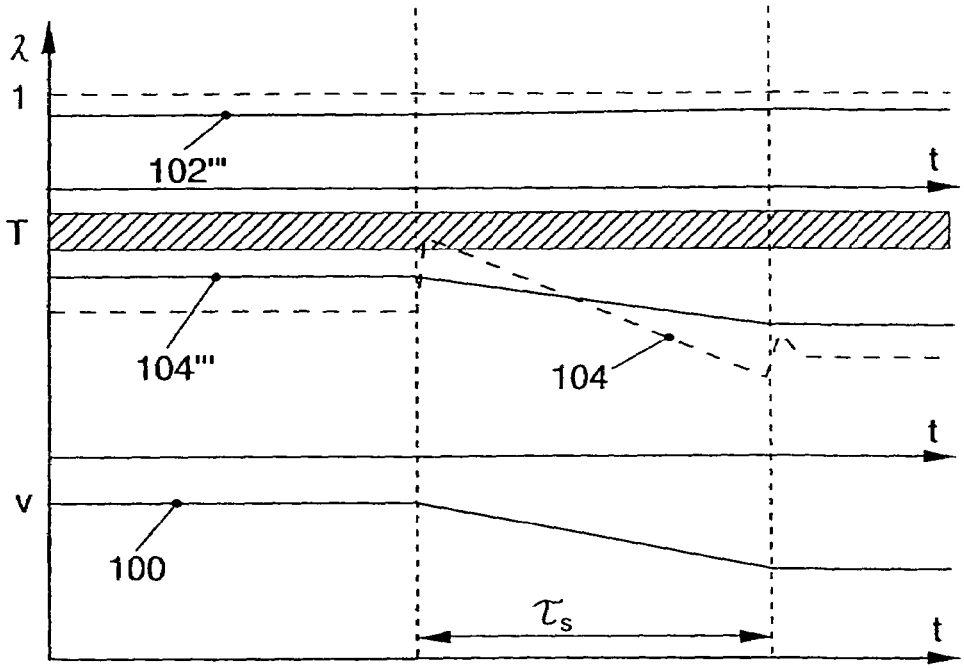
Figure 6:
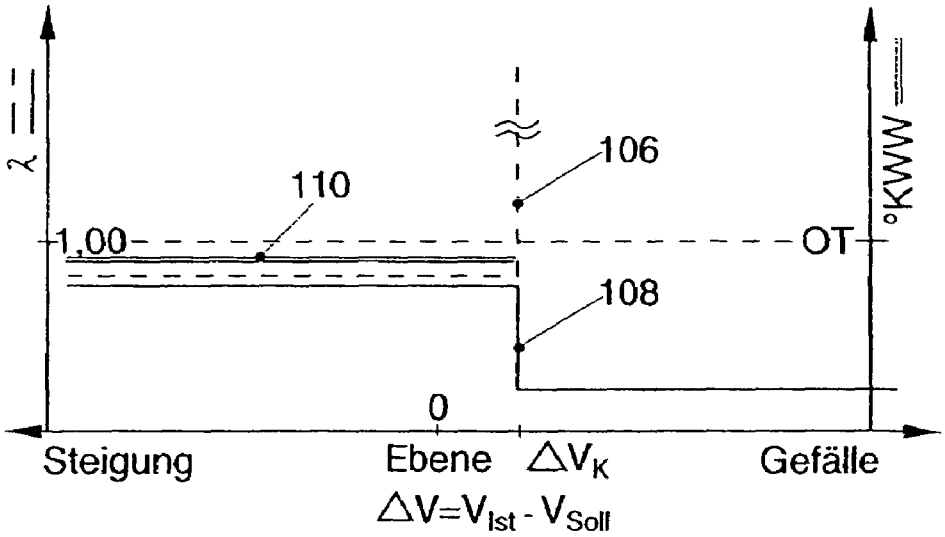
Figure 7:
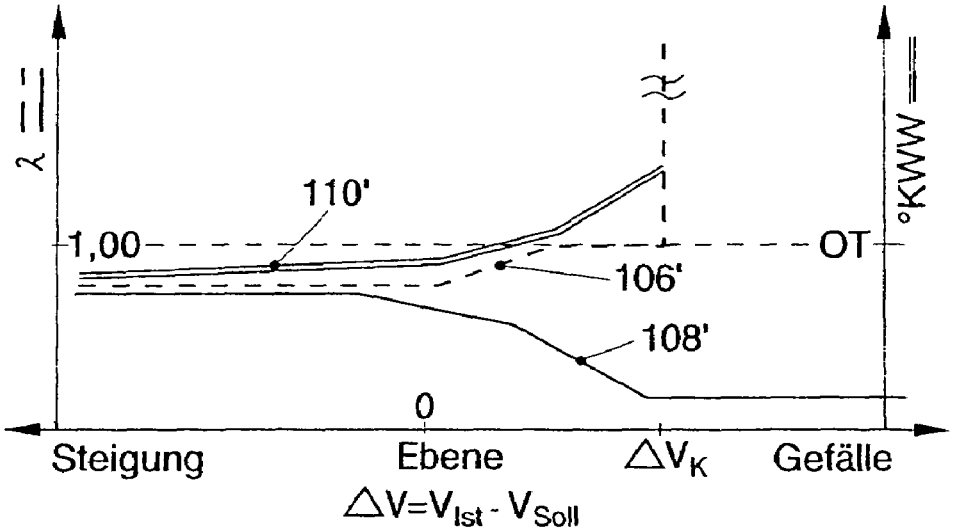

The invention will be described hereinafter in more detail with reference to embodiments depicted in the appended drawings. It is shown in:

FIG. 1 schematically, an arrangement of an internal combustion engine with a downstream exhaust gas tract;

FIG. 2 diagrams showing the time-dependence of an air-fuel ratio of a catalyst temperature as well as a vehicle speed during an overrun phase with conventional overrun fuel cutoff;

FIG. 3 diagrams showing the time-dependence of the quantities of FIG. 2 according to a first embodiment of the present invention;

FIG. 4 diagrams showing the time-dependence of the quantities of FIG. 2 according to a second embodiment of the present invention;

FIG. 5 diagrams showing the time-dependence of the quantities of FIG. 2 according to a third embodiment of the present invention;

FIG. 6 diagrams showing the air-fuel ratio as a function of the downgrade as well as a firing angle during an overrun mode and during a vehicle drive mode according to a fourth embodiment of the present invention; and FIG. 7 diagrams of the variables according to FIG. 6 as a function of the downgrade according to a fifth embodiment of the present invention.

FIG. 1 depicts schematically an internal combustion engine 10 with a downstream exhaust channel 12. For cleaning an exhaust gas produced by the internal combustion engine 10, the exhaust channel 12 includes a small-volume pre-catalyst 14 located close to the engine, typically a three-way catalyst, as well as a large-volume $NO_x$ storage catalyst 16 arranged downstream of the pre-catalyst 14. The $NO_x$ storage catalyst 16 is supplied discontinuously with lean and rich exhaust gas atmospheres, wherein during the lean operating phases nitric oxides $NO_x$ are stored and during the rich operating phases a $NO_x$ regeneration and conversion is performed. The lean-rich cycles as well as the air-fuel ratio Lambda are typically controlled with a Lambda sensor 18 connected downstream of the internal combustion engine 10 as well as with another gas sensor 20 located in downstream of the $NO_x$ storage catalyst 16.

The gas sensor 20 can also be implemented as a Lambda sensor or preferably a $NO_x$ sensor. A temperature sensor 22 determines an exhaust gas temperature before the $NO_x$ storage catalyst 16. The signals provided by the sensors 18, 20, 22 as well as the different operating parameters of the internal combustion engine 10 are supplied to the input of an engine controller 24 which controls the internal combustion engine 10 based on the stored algorithms and characteristic operating parameters.

FIG. 2 illustrates—based on curves of the different characteristic parameters—the temperature load during an allowed conventional overrun fuel cutoff which can damage the catalyst. The diagram 100 shows a curve with a vehicle speed v. The speed v is initially at a constant high level, then decreases steadily in a deceleration phase, for example because the driver reduces a fuel request, and finally assumes a constant low level. During the deceleration phase, the vehicle is in an overrun phase $\tau_s$ where the requested drive torque is smaller than an instantaneous overrun torque produced by the vehicle. The time-dependence of the air-fuel ratio $\lambda$ is depicted in diagram 102. During the initial operation under high load, the mixture is relatively strongly enriched with $\lambda<1$. During the overrun phase $\tau_s$, during which the engine does not perform work and the vehicle speed v is maintained only by the overrun torque, an overrun fuel cutoff occurs through interruption of the fuel supply. As a result, the air-fuel ratio $\lambda$ assumes initially an almost infinite positive value. The high oxygen concentration of the exhaust gas during overrun fuel cutoff can cause intensive conversion reactions as a result of the initially still high HC-concentration in the catalysts 14, 16. Diagram 104 indicates the curves of the local temperature in a coating (wash coat) in the reaction zone of the $NO_x$ storage catalyst 16. It can be seen that a strong temperature peak occurs at the beginning of the unfired overrun phase $\tau_s$ after an initial constant catalyst temperature T in operation under high load. Depending on the starting temperature before the overrun fuel cutoff, the temperature peak can reach a critical temperature region (indicated by the dashed region) which irreversibly damage the $NO_x$ storage catalyst 16.

According to the invention, temperature peaks during overrun phases can be effectively eliminated by suppressing the overrun fuel cutoff under specific conditions during the overrun phases, e.g. by firing the internal combustion engine 10 during the overrun phase $\tau_s$. This principle is illustrated in its simplest embodiment in FIG. 3 based on the same vehicle speed profile v as in FIG. 2 (diagram 100). According to this embodiment, a constant Lambda value, preferably between $\lambda=0.95$ and $\lambda=1.00$ is adjusted between the overrun phase $\tau_s$. During the overrun phase $\tau_s$, the internal combustion engine 10 is hence operated with a stoichiometric air-fuel ratio or a small excess of fuel, so that any oxygen is essentially consumed during combustion. As seen in diagram 104', temperature peaks can thereby be almost completely eliminated in the overrun phase $\tau_s$. The temperature curve 104 with the overrun fuel cutoff according to FIG. 2 is also depicted in FIG. 3 for comparison. The absence of pronounced temperature peaks in FIG. 3 significantly extends the lifetime of the catalyst system while simultaneously ensuring a sufficient catalytic activity over the lifetime of the system. However; firing during the overrun phase $\tau_s$ slightly increases the fuel consumption, as compared to allowing the overrun fuel cutoff according to FIG. 2. The increase in fuel consumption can be minimized by suppressing the overrun fuel cutoff depending on the measured or calculated actual temperature of the $NO_x$ catalyst system 14, 16 or the exhaust gas. Suppression of the overrun fuel cutoff is only permitted if the temperature at the beginning of the overrun phase $\tau_s$ is already relatively high, in particular 700° C., preferably 750° C. Lambda can also be set proportional to the existing temperature during the overrun phase $\tau_s$.

FIG. 4 shows a modification of the principle depicted in FIG. 3 with an identical speed profile 100. In addition to suppressing the fuel cutoff during the overrun phase $\tau_s$, the maximum allowable temperature of the exhaust gas and/or the catalyst system during the operation under high load (non-overrun mode) is raised by 30 to 150 K, in particular by 50 to 100 K, as compared to the aforedescribed examples. Based on a typically allowed exhaust gas temperature before the $NO_x$ storage catalyst of approximately 800° C., this corresponds to an exhaust gas temperature before the pre-catalyst 14 of 920 to 1040° C., in particular 950 to 1000° C. Raising the allowable catalyst temperature leads to a generally higher temperature level (diagram 104") as compared to the embodiment depicted in FIG. 3. However, due to the substantially suppressed temperature peak in the overrun phase $\tau_s$, the critical temperature range highlighted by the dashed area in the graph is not reached, so that the temperature-stress imposed on catalyst system is not significantly greater than in the previously described embodiment. The advantage of this embodiment is the higher Lambda value (graph 102") obtained as a result of the temperature control measures, which compensates or even overcompensates for the increased fuel consumption caused by the fired overrun mode.

FIG. 5 shows a modification of the embodiment depicted in FIG. 4 with Lambda curves and temperature curves (102''' and 104'''), whereby if instead of operating with a fixed Lambda setting even during the overrun phase $\tau_s$, the Lambda value is allowed to vary depending on the maximum preset temperature for the exhaust gas and/or the $NO_x$ catalyst 14, 16. This measure typically leads to Lambda values between 0.7 and 0.95 during the overrun phase $\tau_s$, in particular between 0.8 and 0.9. Although this more enriched mixture in the overrun phase $\tau_s$ partially reduces the fuel savings achieved with the embodiment depicted in FIG. 4, it results in an almost complete elimination of temperature peaks in favor of extended catalyst lifetime, since the Lambda value is almost identical under load and under overrun conditions.

Two additional embodiments address the problem associated with an effective torque produced by the fired overrun mode on downgrades. Accordingly, a downgrade is identified by determining a deviation $\Delta v$ between a calculated nominal vehicle speed and/or acceleration on flat land ($v_{soll}$) from an actual vehicle speed ($v_{ist}$) or acceleration. The diagram 106 in FIG. 6 shows the Lambda curve in an overrun phase $\tau_s$ which is regulated depending on the determined speed deviation $\Delta v$. As long as the identified downgrade is smaller than a pre-determinable critical downgrade $\Delta v_k$, the overrun fuel cutoff is suppressed by operating the internal combustion engine 10 fired with a Lambda <1. The air-fuel ratio $\lambda$ is ignited at a constant firing point at a crankshaft angle KWW before the upper dead center OT (diagram 110). If the downgrade is greater than $\Delta v_k$, then overrun fuel cutoff is allowed, resulting in a Lambda value going towards infinity in overrun. This prevents lengthening of the braking distance caused by the effective torque which could otherwise endanger or annoy the driver. Allowing overrun fuel cutoff and/or presetting the critical downgrade $\Delta v_k$ can be regulated depending on the actual exhaust gas or catalyst temperature. Diagram 108 shows the downgrade-dependent Lambda curve in a fired vehicle drive mode, i.e., if an overrun situation is not present. The maximum allowable exhaust gas and/or catalyst temperature is hereby lowered before the critical downgrade $\Delta v_k$, which reduces Lambda due to the required cooling. Lowering the temperature and/or Lambda in vehicle drive mode has the advantage that for a downgrade greater than $\Delta v_k$ an overrun fuel cutoff can be easily implemented when an overrun phase $\tau_s$ begins, without the temperature peak resulting from the supply of oxygen reaching the critical temperature range.

According to another embodiment of the method depicted in FIG. 7, the air-fuel mixture $\lambda$ is steadily raised during the fired overrun phase with increasing downgrade slope at least to Lambda=1 (diagram 106'). Simultaneously, the time of ignition according to diagram 110 is shifted to a crankshaft angle KWW past the upper dead center OT, in order to decrease the combustion efficiency and thereby also the generated effective torque. Overrun fuel cutoff is hereby also allowed when the preset critical downgrade $\Delta v_k$ is exceeded. Conversely, if the vehicle is under engine load (non-overrun mode), then the maximum allowable exhaust gas and/or catalyst temperature is steadily lowered with increasing downgrade slope, which also lowers the Lambda curve according to diagram 108'. The methods illustrated in FIGS. 6 and 7 can improve the catalyst lifetime without significantly impacting fuel consumption. All processes can be adapted, as needed, to the catalyst condition, in particular the catalyst temperature or a preexisting damage. The method depicted in FIG. 7 represents the best adaptation to the driving characteristics.

The aforedescribed embodiments of the method can also be applied to catalyst systems operating on a 3-way basis. The use of pre-catalyst may also not be necessary.

LIST OF REFERENCE NUMERALS

10 internal combustion engine
12 exhaust gas channel
14 pre-catalyst
16 primary catalyst/$NO_x$ storage catalyst
18 Lambda sensor
20 $NO_x$ sensor
22 temperature sensor
24 engine controller
100 time dependence vehicle speed
102 time dependence of Lambda
104 time dependence of temperature (catalyst temperature)
106 downgrade-dependent Lambda curve in overrun
108 downgrade-dependent Lambda curve in vehicle drive mode
110 downgrade-dependent curve of the firing point
KWW crankshaft angle
$\lambda$ air-fuel ratio
OT upper dead center
t time
T catalyst temperature
$\tau_s$ overrun phase
v vehicle speed
$v_{ist}$ actual vehicle speed
$v_{soll}$ theoretical vehicle speed on flat land (nominal vehicle speed)
$\Delta v$ deviation/downgrade
$\Delta v_k$ critical downgrade

The invention claimed is:

1. Method for controlling a temperature of a catalyst system located in an exhaust duct of an internal combustion engine of a motor vehicle, the catalyst system comprising at least one primary catalyst and optionally one or more pre-catalysts catalysts, the method comprising:

suppressing an overrun fuel cutoff at an operating point where a desired driving torque requested by a driver is smaller than an overrun torque of the vehicle (overrun phase $\tau_s$), for maintaining temperature of at least one of the catalyst system and exhaust gas below predetermined value, by supplying the internal combustion engine with an air-fuel ratio ($\lambda$) having a value smaller than or equal to 1.1, wherein the suppressing of the overrun fuel cutoff in the overrun phase ($\tau_s$) includes performing at least one of the following measures defining the air-fuel ratio ($\lambda$) applied during the overrun phase ($\tau_s$) as a function of a measured or calculated temperature of at least one of the exhaust gas and the catalyst system, and at least partially compensating a useful torque produced by the suppression of the overrun fuel cutoff during the overrun phase ($\tau_s$) by retarding an ignition point.

2. Method according to claim 1, wherein the primary catalyst is implemented as a $NO_x$ storage catalyst.

3. Method according to claim 1, wherein the internal combustion engine is supplied during the overrun phase ($\tau_s$) with an air-fuel ratio ($\lambda$) less than or equal to 1.05.

4. Method according to claim 3, wherein the internal combustion engine is supplied during the overrun phase ($\tau_s$) with an air-fuel ratio ($\lambda$)less than or equal to 1.02.

5. Method according to claim 1, wherein the internal combustion engine is supplied during the overrun phase ($\tau_s$) with an air-fuel ratio ($\lambda$) of 0.95 to 1.00.

6. Method according to claim 1, wherein the overrun fuel cutoff is not suppressed if the measured or calculated temperature of at least one of the exhaust gas and the catalyst system does not exceed a presettable temperature threshold.

7. Method according to claim 1, wherein in a vehicle drive phase (non-overrun phase) of the internal combustion engine, a maximum allowable temperature ($T_{max}$) of the exhaust gas before the $NO_x$ storage catalyst is preset between 920 and 1040 ° C., and the air-fuel ratio ($\lambda$) is regulated as a function of the preset temperature ($T_{max}$).

8. Method according to claim 7, wherein during the overrun phase ($\tau_s$) the internal combustion engine is supplied with an air-fuel ratio ($\lambda$) that changes depending on a preset maximum allowable temperature ($T_{max}$) of at least one of the exhaust gas and the catalyst system.

9. Method according to claim 7, wherein the preset temperature ($T_{max}$) is 950 and 1000° C.

10. Method according to claim 1, wherein in a vehicle drive phase (non-overrun phase of the internal combustion engine a maximum allowable temperature ($T_{max}$) of the exhaust gas before the $NO_x$ storage catalyst is preset between 830 and 920° C., and the air-fuel ratio ($\lambda$) is regulated as a function of the preset temperature ($T_{max}$).

11. Method according to claim 10, wherein the preset temperature ($T_{max}$) is between 850 and 880° C.

12. Method according to claim 1 wherein at least one of the suppression of the overrun fuel cutoff, ratio ($\lambda$) applied during the overrun phase ($\tau_s$) with suppressed overrun fuel cutoff and a maximum allowable preset temperature ($T_{max}$) for the catalyst system is regulated as a function of an identified downgrade slope.

13. Method according to claim 12, wherein the downgrade slope is determined based on at least one of a deviation ($\Delta v$) of an actual vehicle speed ($v_{ist}$) from a vehicle speed ($v_{soll}$) to be expected on flat land based on an actual engine torque and a deviation of an actual vehicle acceleration from a vehicle acceleration to be expected on flat land based on an actual engine torque.

14. Method according to claim 13, wherein in the overrun phase ($\tau_s$) at least one of the air-fuel ratio ($\lambda$) and a maximum allowable preset temperature ($T_{max}$) for at least one of the exhaust gas and the catalyst system is raised stepwise or continuously with an increasing downgrade slope that is identified based on at least one of the deviation ($\Delta v$) of the actual vehicle speed ($v_{ist}$) from the expected vehicle speed and the deviation of the actual vehicle acceleration from the expected vehicle acceleration.

15. Method according to claim 13, wherein at least one of the expected vehicle speed ($v_{soll}$) and the expected vehicle acceleration on flat land is determined depending on a torque supplied by the internal combustion engine or a quantity that correlates with the torque, based on at least one of stored parameters and parameter fields.

16. Method according to claim 12, wherein the primary catalyst is implemented as a $NO_x$ storage catalyst.

17. Method according to claim 12, wherein the internal combustion engine is supplied during the overrun phase ($\tau_s$) with an air-fuel ratio ($\lambda$) less than or equal to 1.05.

18. Method according to claim 17, wherein the internal combustion engine is supplied during the overrun phase ($\tau_s$) with an air-fuel ratio ($\lambda$)less than or equal to 1.02.

19. Method according to claim 12, wherein the internal combustion engine is supplied during the overrun phase ($\tau_s$) with an air-fuel ratio ($\lambda$) of 0.95 to 1.00.

20. Method according to claim 12, wherein the overrun fuel cutoff is not suppressed if the measured or calculated temperature of at least one of the exhaust gas and the catalyst system does not exceed a presettable temperature threshold.

21. Method according to claim 12, wherein in a vehicle drive phase (non-overrun phase) of the internal combustion engine, a maximum allowable temperature ($T_{max}$) of the exhaust gas before the $NO_x$ storage catalyst is preset between 920 and 1040° C. and the air-fuel ratio ($\lambda$) is regulated as a function of the preset temperature ($T_{max}$).

22. Method according to claim 21, wherein during the overrun phase ($\tau_s$) the internal combustion engine is supplied with an air-fuel ratio ($\lambda$) that changes depending on a preset maximum allowable temperature ($T_{max}$) of at least one of the exhaust gas and the catalyst system.

23. Method according to claim 21, wherein the preset temperature ($T_{max}$) is 950 and 1000° C.

24. Method according to claim 12, wherein in a the vehicle drive phase (non-overrun phase) of the internal combustion engine a maximum allowable temperature ($T_{max}$) of the exhaust gas before the $NO_x$storage catalyst is preset between 830 and 920° C. and the air-fuel ratio ($\lambda$) is regulated as a function of the preset temperature ($T_{max}$).

25. Method according to claim 24, wherein the preset temperature ($T_{max}$) is between 850 and 880° C.

26. Method according to claim 12, wherein in an overrun phase ($\tau_s$) the suppression of the overrun fuel cutoff is canceled when an identified downgrade slope exceeds a presettable limit value.

27. Method according to claim 12, wherein in an overrun phase ($\tau_s$) an ignition time is retarded stepwise or continuously with increasing downgrade slope.

28. Method according to claim 12, wherein in a vehicle drive mode (non-overrun phase) of the internal combustion engine, a maximum allowable preset temperature ($T_{max}$) of at least one of the exhaust gas and the catalyst system is lowered at least one of stepwise and continuously with increasing downgrade slope.

29. Method according to claim 12, wherein at least one of the actual vehicle speed ($v_{ist}$) and actual vehicle acceleration is determined based on at least one of an engine rotation speed and an engaged gear, and a measured wheel rotation speed and a dynamic wheel radius.

30. Method for controlling a temperature of a catalyst system located in an exhaust duct of an internal combustion engine of a motor vehicle, the catalyst system comprising at least one primary catalyst and optionally one or more pre-catalysts, the method comprising:

suppressing an overrun fuel cutoff at an operating point where a desired driving torque requested by a driver is smaller than an overrun torque of the vehicle (overrun phase $\tau_s$), for maintaining temperature of at least one of the catalyst system and exhaust gas below a predetermined value, by supplying the internal combustion engine with an air-fuel ratio having a $\lambda$ value smaller than or equal to 1.1, wherein the suppressing of the overrun fuel cutoff in the overrun phase includes regulating at least one of the air-fuel ratio ($\lambda$) applied during the overrun phase ($\tau_s$) with suppressed overrun fuel cutoff and a maximum allowable preset temperature ($T_{max}$) for the catalyst system as a function of an identified downgrade slope.

* * * * *